US006234879B1

(12) United States Patent
Hasegawa et al.

(10) Patent No.: US 6,234,879 B1
(45) **Date of Patent: *May 22, 2001**

(54) METHOD AND APPARATUS FOR WAFER CHAMFER POLISHING

(75) Inventors: Fumihiko Hasegawa, Urawa; Tatsuo Ohtani; Yasuyoshi Kuroda, both of Fukushima-ken, all of (JP)

(73) Assignee: Shin-Etsu Handotai Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/619,882

(22) Filed: Mar. 20, 1996

Related U.S. Application Data

(62) Division of application No. 08/072,741, filed on Jun. 7, 1993, now Pat. No. 5,547,415.

(30) Foreign Application Priority Data

Jul. 31, 1992 (JP) ..... 4-053886 U
Jul. 31, 1992 (JP) ..... 4-205275

(51) Int. Cl.[7] ..... B24B 9/00
(52) U.S. Cl. ..... 451/44; 451/180; 451/541
(58) Field of Search ..... 451/44, 43, 461, 451/545, 541, 462, 430, 180

(56) References Cited

U.S. PATENT DOCUMENTS

| | | | | |
|---|---|---|---|---|
| 1,437,234 | * | 11/1922 | Fraser | 451/28 |
| 2,693,063 | * | 11/1954 | Dillon | 451/43 |
| 2,745,225 | * | 5/1956 | Vonada | 451/180 |
| 5,044,123 | * | 9/1991 | Hoffman | 451/180 |
| 5,094,037 | | 3/1992 | Hakomori et al. . | |
| 5,097,630 | | 3/1992 | Maeda et al. . | |
| 5,117,590 | | 6/1992 | Kudo et al. . | |

FOREIGN PATENT DOCUMENTS

| | | | | |
|---|---|---|---|---|
| 074767 | * | 9/1917 | (CH) | 451/180 |
| 3838898 | | 11/1988 | (DE) . | |
| 4031163 | | 10/1990 | (DE) . | |
| 0216054 | | 4/1987 | (EP) . | |
| 0345586 | | 2/1990 | (EP) . | |
| 1020959 | * | 1/1989 | (JP) | 451/44 |

* cited by examiner

*Primary Examiner*—Robert A. Rose
(74) *Attorney, Agent, or Firm*—McGuireWoods LLP

(57) ABSTRACT

A method and apparatus for polishing chamfers made along the periphery of a semiconductor wafer designed such that when the wafer is once picked up by a rotatory suction cup of a transportation robot arm, the wafer is not released from the suction cup until the entire polishing operation is completed; in an embodiment, a circular turn table having six wafer suction cups is employed which is adapted to turn step-wise, each step consisting of a turn through an angle of 60° to transfer the wafers.

1 Claim, 7 Drawing Sheets

METHOD AND APPARATUS FOR WAFER CHAMFER POLISHING

This application is a division of application Ser. No. 08/072,741, filed on Jun. 7, 1993 now U.S. Pat. No. 5,547, 415.

This application is related to a copending patent application titled "A WAFER CHAMFER POLISHING APPARATUS WITH ROTARY CIRCULAR DIVIDING TABLE" for which foreign priority benefits are claimed on the basis of Japanese Utility Model Application No. 4-50005 filed on Jul. 16, 1992. Said copending application is commonly assigned with the present application.

BACKGROUND OF THE INVENTION

The present invention relates to a method and an apparatus for polishing the chamfers made along the periphery of a semiconductor wafer.

DESCRIPTION OF THE PRIOR ART

FIG. 8 and FIG. 9 show a conventional wafer chamfer polishing apparatus. FIG. 8 is a top plan view of the wafer chamfer polishing apparatus, and FIG. 9 is a view seen in the direction of arrow H of FIG. 8. In this wafer chamfer polishing apparatus, the wafers W, which are taken out from a cassette 101 one by one, are transported to an OF (orientation flat) orientating assembly 103 by means of a conveyor 102. At this OF orientating assembly 103, each wafer W is turned circumferentially until the OF edge portion 200 of the wafer faces a certain predetermined direction, and thus orientated wafer W is sucked by a suction cup 104*a* of a setter arm 104, which swings to bring the wafer to a wafer suction cup assembly 105, where the wafer is released by the setter arm 104 and sucked and held by the wafer suction cup assembly 105.

As the wafer suction cup assembly 105 turns, the wafer W adsorbed to the cup due to the negative pressure created thereat (hereinafter "vacuum-held") is also turned circumferentially and its periphery with chamfers is entirely polished by a turning buff 106, which is pressed against the periphery of the wafer. The thus polished wafer W is then vacuum-held by a suction cup 107*a* of a remover arm 107, and transported to a location above a cleaning tank 108, and there it is released from the remover arm 107 to fall into the cleaning tank 108 to be cleaned with the cleaning liquid contained therein; thus the polishing of the chamfers of the wafer W is completed.

Problems the Invention Seeks to Solve

However, in such conventional wafer chamfer polishing apparatus as described above, each wafer W is passed from the setter arm 104 to the wafer suction cup 105, and then to the remover arm 107, and this wafer passing is conducted in the presence of polishing slurry so that not infrequently troubles take place as the wafers W are passed on; such troubles include pollution and physical damages such as chipping of the wafer. What is more, since the cycle time is extended by the length of time required for this wafer passing, the operation efficiency of the polishing apparatus is limited. Thus, in the technology of wafer chamfer polishing, it is desirous that once a wafer is sucked and held by a suction cup the wafer stays on the same cup during the entire process of wafer chamfer polishing.

The chamfers of a wafer W are polished in a manner as shown in FIG. 9: that is, the buff 106 is pressed on the wafer W laterally such that a buff groove 106*a* formed horizontally in the side wall of the buff 106 is fitted over the periphery of the wafer W. However, in this manner, of the chamfers of the wafer W shown in FIG. 10, either the tapered chamfers X1 and X2 are first polished and consequently the outermost chamfer X3 is polished with some delay or vice versa. This results in longer polishing time.

The present invention was made in view of these problems, and it is, therefore, an object of the invention to provide a method and an apparatus for polishing the peripheral chamfers of a wafer which enable elimination of wafer transfer operation and thus improve operation efficiency and dependability.

SUMMARY OF THE INVENTION

Means to Solve the Problems

In order to attain the objects of the invention, there is provided a method for polishing chamfers made along the periphery of a semiconductor wafer comprising steps of picking up a wafer from a wafer supply station, bringing the wafer to a wafer polish station where the wafer's chamfers are polished, bringing the wafer to a wafer clean station where the wafer is cleaned, and bringing the wafer to a wafer discharge station where the wafer is discharged, and this method is characterized in that when the wafer is once picked up by a transportation means at the wafer supply station, the wafer is not released by the transportation means until the wafer is discharged at the wafer discharge station.

This method is applicable to wafers which have an OF periphery, and in this case, both the chamfers along the orientation flat portion of the wafer edge or periphery, hereinafter referred to as an OF periphery and those along remainder of the periphery of the wafer, hereinafter referred to as the non-OF periphery, are polished at the wafer polish station.

The invention also provides an apparatus for polishing the chamfers made along the periphery of a semiconductor wafer, which comprises a wafer supply station from which the wafer is picked up, a wafer polish station where the wafer's chamfers are polished, a wafer clean station where the wafer is cleaned, a wafer discharge station where the wafer is discharged, and a wafer transportation means for picking up the wafer, turning the wafer circumferentially, and transporting the wafer to the wafer polish station, to the wafer clean station, and to the wafer discharge station in this order, and this wafer transportation means is further adapted to keep holding the wafer as it carries the wafer from the wafer supply station until it releases the wafer at the wafer discharge station.

It is also proposed to design the apparatus such that the wafer polish station is capable of polishing both the chamfers along the OF periphery and those along the non-OF periphery of the wafer.

In a first embodiment, the wafer supply station, the wafer polish station, the wafer clean station, and the wafer discharge station are arranged in a row along a straight line, and the wafer transportation means is adapted to transport the wafer in a manner such that the center of the wafer traces a locus identical to the straight line; the wafer polish station including a cup-like cylindrical hollow buff having polishing surfaces both inside and outside the wall of the buff and adapted to rotate axially.

Preferably in this first embodiment the wafer transportation means consists of two wafer holder assemblies each including an arm having a wafer suction cup at the fore end and adapted to shift vertically.

In a second embodiment, the wafer transportation means consists of a circular turn table having rotary wafer suction cups arranged equiangularly along the circumference of the turn table and the turn table is adapted to turn step-wise, each step consisting of a turn through a predetermined angle, and to transport the wafer in a manner such that the center of the wafer traces a circular locus along which the stations are arranged equiangularly.

In a preferred version of the second embodiment, the non-OF chamfers polish substation includes two cylindrical rotary buffs, one of which is formed with a groove in its side wall to receive the non-OF peripheral edge of the wafer in it, the two buffs being arranged in a manner such that they are simultaneously pressed on the periphery of the wafer, which is vacuum-held and turned by one of the rotary suction cups.

In a preferable third embodiment, there is provided a wafer cassette transportation system which is adapted to transport wafer cassettes from the wafer supply station to the wafer discharge station so that a wafer cassette from which wafers have been all taken out at the wafer supply station can serve to receive the polished wafers discharged at the wafer discharge station.

Effects of the Invention

According to the first embodiment of the invention, once a wafer is picked up and vacuum-held by the suction cup of one of the two wafer holder assemblies the wafer W stays on the same cup throughout the series of polishing operation from wafer pick-up till wafer release, so that there is no occasion of transferring a wafer from one suction cup to another; as the result, the time-efficiency of the polishing operation is improved and the occurrences of contamination and physical damages of wafers such as chipping are minimized.

Furthermore, according to the second embodiment of the invention also, each wafer is kept held by a sane wafer suction cup throughout the entire procedure and there occurs no transference of the wafer between suction cups; therefore, the same result is obtained as in the first embodiment.

According to a preferred version of the second embodiment, with reference to FIG. 10, both the tapered chamfers X1 and X2 are polished more selectively by the buff with the groove and simultaneously as this the outermost chamfer X3 is more selectively polished by the buff without a groove; consequently, all of the chamfers of the non-OF periphery are polished at once; in other words, the time required for the chamfer polishing is much reduced and it is now possible to further rationalize the chamfer polishing operation.

According to the third embodiment, it is not necessary to manually remove the empty cassette from the wafer supply station, nor is it necessary to manually place an empty cassette in the wafer discharge station; as the result, the operation efficiency is improved.

These and other objects and many of the attendant advantages of this invention will be readily appreciated as the same becomes better understood by reference to the following detailed description when considered in connection with the accompanying drawing.

EMBODIMENT

Next, a first embodiment of the invention will be described with reference to attached drawings.

Figure 1:
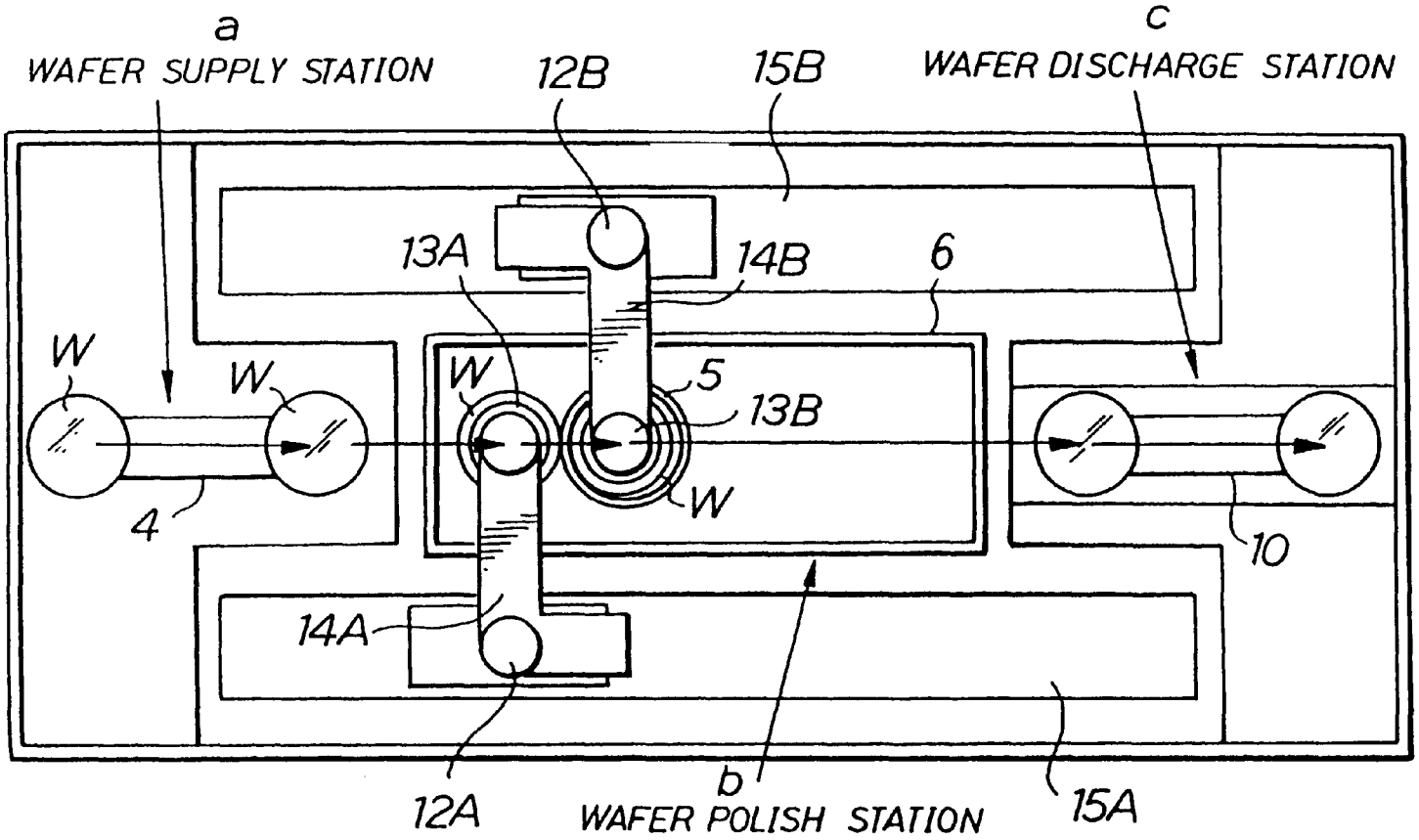
FIG. 1 is a top plan view of a wafer chamfer polishing apparatus according to the first embodiment of the invention.
Figure 2:
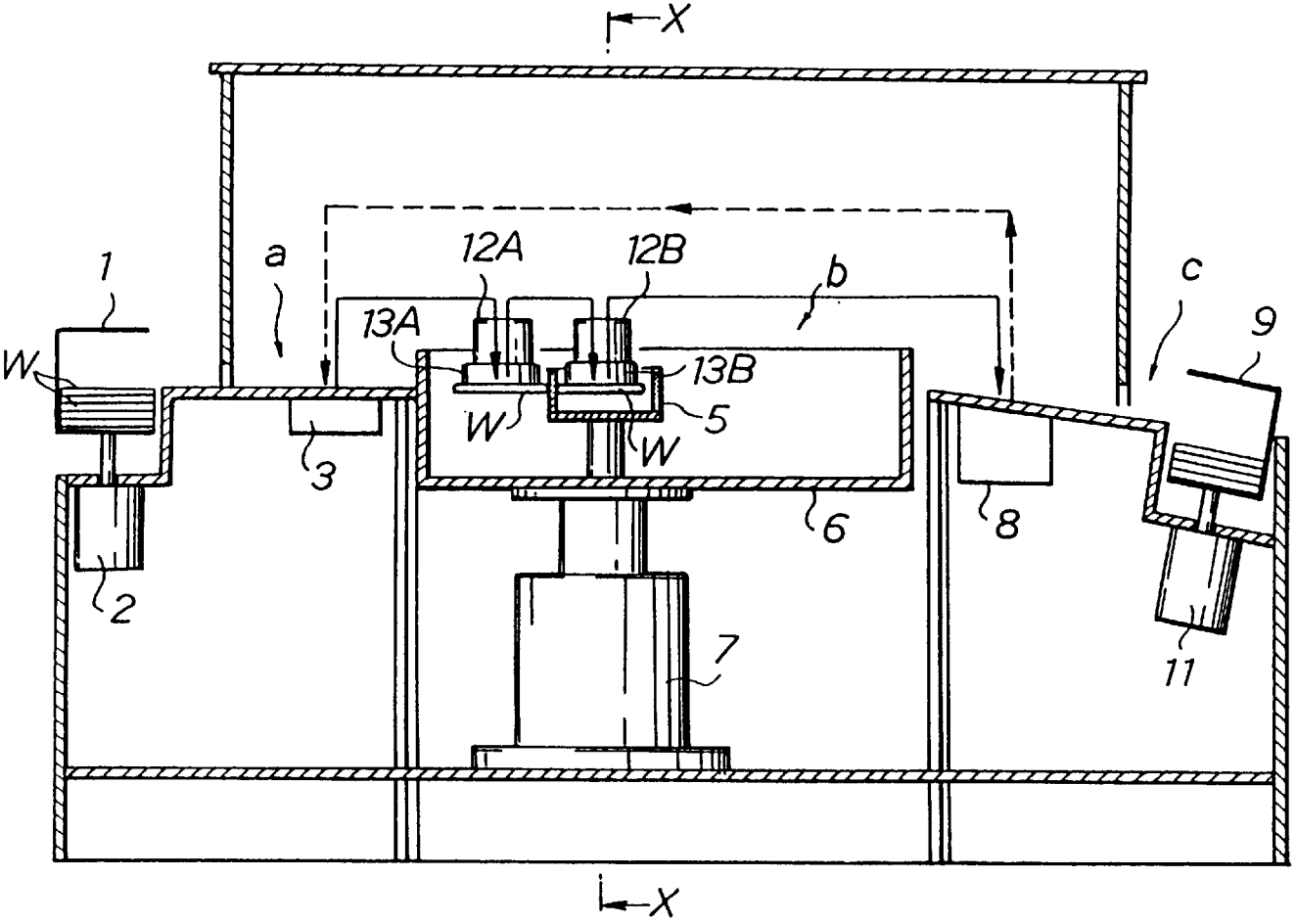
FIG. 2 is a vertical cross sectional view of the wafer chamfer polishing apparatus according to the first embodiment of the invention.
Figure 3:
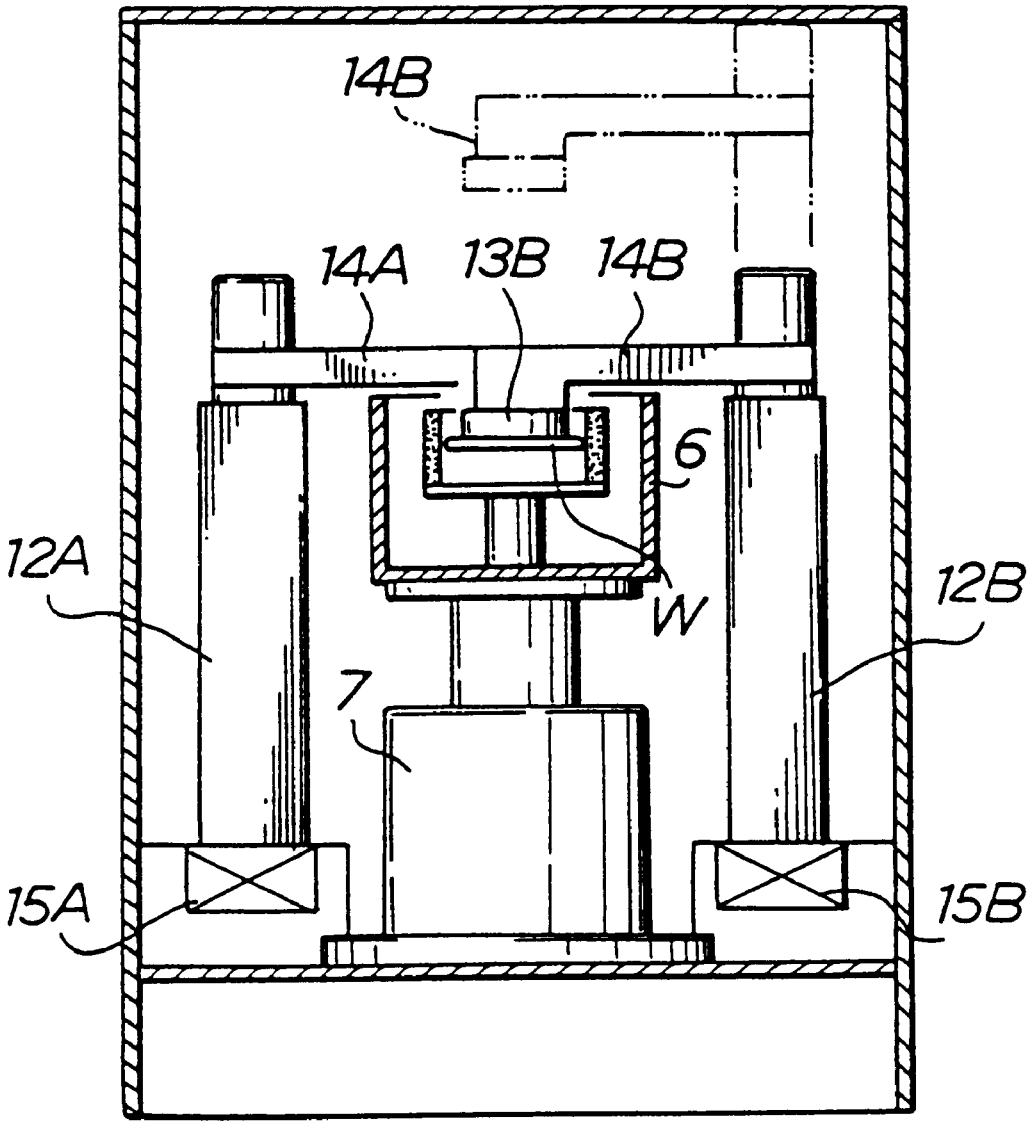
FIG. 3 is a cross section taken on line X—X of FIG. 2.

FIG. 1 is a top plan view of a wafer chamfer polishing apparatus according to the first embodiment of the invention; FIG. 2 is a vertical cross sectional view of the same apparatus; and FIG. 3 is a cross section taken on line X—X of FIG. 2.

In the wafer chamfer polishing apparatus of this embodiment, which is rectangular when seen from above (FIG. 1), each wafer is passed along that center line of the rectangular apparatus which is parallel to the longer sides of the apparatus. Along this center line are arranged in series a wafer supply station a, a wafer polish station b, and a wafer discharge station c.

At the wafer supply station a, the reference numeral 1 (FIG. 2) designates a cassette containing a plurality of unpolished wafers W, and this cassette 1 is supported by the vertical rod of an air cylinder 2, which shifts the cassette 1 vertically. The reference numeral 3 designates an OF orientating assembly, and the belt of a belt conveyor 4, as a wafer transportation means, is wound round a pair of rollers, not shown, to run between the OF orientating assembly 3 and the cassette 1.

At the wafer polish station b, a cylindrical hollow buff 5 is supported to rotate freely by a vertical rotary shaft in a case 6, which 5 opens upward and is adapted to be turned at a predetermined rate by means of a buff drive unit 7; the cylindrical buff 5 is also adapted to shift vertically.

At the wafer discharge station c are provided a wafer cleaning assembly 8 and a cassette 9, and the belt of a belt conveyor 10, as a wafer transportation means, is wound round a pair of rollers, not shown, to run between the wafer cleaning assembly 8 and the cassette 9. The cassette 9 is for collecting the polished wafers W one by one as they are discharged. This cassette 9 is supported by an air cylinder 11, which shifts the cassette 9 generally vertically.

Further, in this wafer chamfer polishing apparatus, linear guides 15A, 15B, which are parallel to each other, are provided alongside the wafer supply station a, the wafer polish station b, and the wafer discharge station c, and a pair of wafer holder assemblies 12A, 12B are rooted in the respective linear guides 15A, 15B so that the wafer holder assemblies 12A, 12B are free to reciprocate between the ends of the respective linear guides 15A, 15B (that is, in the direction of rightward and leftward, as viewed in FIG. 1). Each wafer holder assembly 12A, 12B comprises an arm 14A, 14B having a wafer suction cup 13A, 13B at the fore end, and the suction arm 14A, 14B is adapted to be shifted vertically. Incidentally, the wafer suction cups 13A, 13B are driven by respective drive means, not shown, to turn at a predetermined rate, and are pneumatically connected to a vacuum pump so that they are capable of sucking in the air.

Next, the operation of the wafer chamfer polishing apparatus of this embodiment will be described in detail.

At the wafer supply station a, the unpolished wafers W piled in the cassette 1 are taken out one by one from the top wafer and transported on the belt conveyor 4 to the OF orientating assembly 3, where each wafer W is turned circumferentially until the OF edge thereof faces a certain direction. The thus orientated wafer W is sucked by either the suction cup 13A of the wafer holder assembly 12A or the suction cup 13B of the wafer holder assembly 12B. This sucking of the wafer W by the wafer suction cup 13A, 13B is effected as the wafer suction cup 13A, 13B is pneumatically activated by means of a vacuum pump, not shown. Let us suppose that a first wafer W is now vacuum-held by the suction cup 13A of the wafer holder assembly 12A.

With the first wafer W sucked by the wafer suction cup 13A, the wafer holder assembly 12A is caused to operate such that it raises its arm 13A and moves along the linear guide 15A till the first wafer W arrives at the wafer polish station b, and then it lowers its arm 13A till the first wafer W is level with the middle portion of the buff 5. Then, the wafer W held by the wafer suction cup 13A of the wafer holder assembly 12A is turned circumferentially through a predetermined angle by means of a drive means, not shown, so that its chamfers along the OF periphery are buffed against the outer wall of the cylindrical buff 5, as shown in FIG. 1 and FIG. 2. Incidentally, at this juncture the cylindrical buff 5 is also driven by the buff drive unit 7 to turn at a predetermined rate.

Meanwhile, inside the cylindrical buff 5 a second wafer W (whose OF chamfers have already been polished) is vacuum-held by the wafer suction cup 13B of the arm 14B of the wafer holder assembly 12B and is having its non-OF chamfers (chamfers along the circular periphery) polished by the inner wall of the turning cylindrical buff 5. Incidentally, at this juncture the wafer suction cup 13B together with the wafer W held thereby is driven by its drive means, not shown, to turn at a predetermined rate.

Thus, when the chamfers of the OF periphery and the non-OF periphery of the wafers W vacuum-held by the wafer holder assemblies 12A, 12B, are completely polished, the wafer holder assembly 12B is caused to operate such that it raises its arm 13B and moves along the linear guide 15B till the second wafer W arrives at the wafer discharge station c, and then it lowers its arm 13B till the second wafer W is submerged in the cleaning liquid contained in the wafer cleaning assembly 8, and then the wafer holder assembly 12B releases the second wafer W and rises (as drawn in broken line in FIG. 3) and returns to the wafer supply station a, tracing the passage indicated by the arrows drawn in broken line in FIG. 2. The wafer holder assembly 12B then has its arm 14B descend over the OF orientating assembly 3 and has the suction cup 13B suck up a third wafer W, which has been oriented at the OF orientating assembly 3. With the third wafer W thus sucked by the wafer suction cup 13B, the wafer holder assembly 12B is caused to operate such that it raises its arm 13B and moves along the linear guide 15B till the third wafer W arrives at the wafer polish station b, and then it lowers its arm 13B so that the chamfers along the OF periphery are buffed against the outer wall of the cylindrical buff 5. Meanwhile, at the wafer discharge station c the second wafer W cleaned in the wafer cleaning assembly 8 is then transported to the cassette 9 by the belt conveyor 10.

On the other hand, when the OF chamfers of the first wafer W are completely polished by the running outer wall of the cylindrical buff 5, the wafer holder assembly 12A is caused to operate such that it raises its arm 13A and moves along the linear guide 15A till the first wafer W comes over the hollow of the cylindrical buff 5, and then it lowers its arm 13A till the first wafer W is well inside the cylindrical buff 5. The non-OF chamfers of the first wafer W held by the wafer holder assembly 12A are then brushed by the running inner wall of the cylindrical buff 5.

By continuing this series of operation it is possible to continually polish the peripheral chamfers of the wafers W.

Thus, according to this embodiment of the invention, once a wafer is sucked and held by the suction cup of a wafer holder assembly 12A or 12B the wafer W stays on the same cup throughout the series of polishing operation from wafer pick-up till wafer release, so that there is no occasion of transferring a wafer from one suction cup to another; as the result, the time-efficiency of the polishing operation is improved and the occurrences of contamination and physical damages of wafers such as chipping are minimized.

Next, a second embodiment of the invention will be described with reference to FIG. 4 and FIG. 5. Incidentally, FIG. 4 is a top plan view of a wafer chamfer polishing apparatus with a rotary circular dividing table according to the second embodiment of the invention, and FIG. 5 is a cross-sectional view taken on the vertical cross section indicated by the line Y—Y of FIG. 4.

Figure 4:
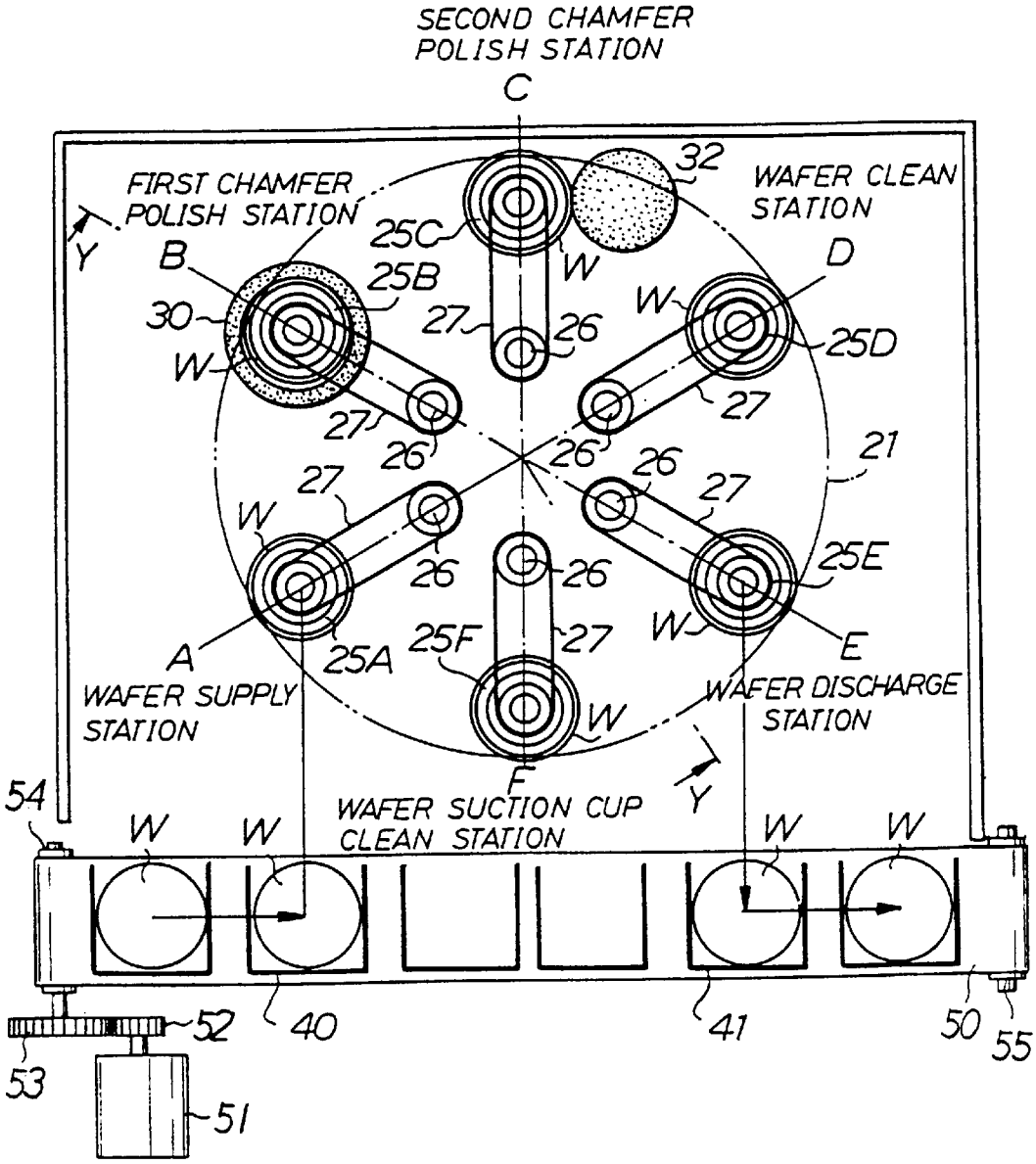
FIG. 4 is a top plan view of a wafer chamfer polishing apparatus with a rotary circular dividing table according to the second embodiment of the invention.
Figure 5:
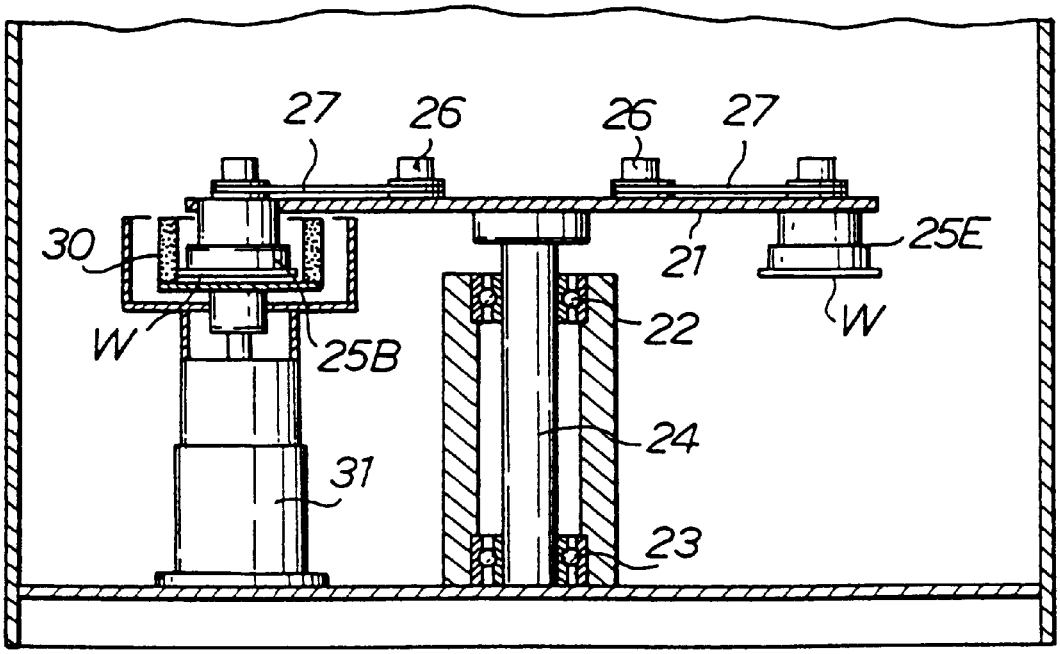
FIG. 5 is a cross-sectional view taken on the vertical cross section indicated by the line Y—Y of FIG. 4.

In FIG. 4 and FIG. 5, the reference numeral 21 designates a circular turn disk (circular dividing table), which is horizontally supported on top of a vertical rotary shaft 24, which is provided in the center with its upper end portion supported freely rotative by a bearing 22 and with its lower end portion supported freely rotative by a bearing 23. Incidentally, the rotary shaft 24 and the turn disk 21 are driven by a drive means, not shown, to turn stepwise, each step consisting of a turn through a predetermined angle (60° in this embodiment).

In the vicinity of the periphery of the turn disk 21 are made six vertical bores at locations equidistant from, and equiangularly with respect to, the center of the turn disk 21 (at regular angular intervals of 60 degrees), and through these bores are passed vertical rotary shafts in a manner such that each rotary shaft is freely rotative in the respective bore but cannot slide in it vertically. The lower ends of the rotary shafts are respectively provided with horizontal wafer suction cups 25A, 25B, 25C, 25D, 25E, and 25F; and about the upper end portions of the rotary shafts are locked, respectively, horizontal pulleys. Six wafer drive motors 26 are mounted on the turn disk 21 at locations about the middle of the respective lines connecting the center of the turn disk 21 and the respective rotary shafts of the wafer suction cups. An endless belt 27 is wound around each pair of rotary shaft of the wafer suction cup and the pulley of the wafer drive motor 26, so that each suction cup 25 is driven to rotate about its axis of rotation by respective wafer drive motor 26.

As shown in FIG. 4, a wafer supply station A, a first chamfer polish station B, a second chamfer polish station C, a wafer clean station D, a wafer discharge station E, and a wafer suction cup clean station F are located equiangularly with respect to the center of the rotary shaft 24 (at regular angular intervals of 60°). Although only the second chamfer polish station C is shown in FIG. 5, the six stations A, B, C, D, E, F are assembled under the turn disk 21 at locations where the wafer suction cups 25A through 25F pass as the turn disk 21 is turned.

The first chamfer polish station B is adapted to polish the chamfers along the non-OF periphery (circular periphery) of the wafer W, and its rough structure is shown in FIG. 5. In FIG. 5, it is seen that the first chamfer polish station B has a hollow cylindrical buff 30, which 30 has an inner buffing wall and opens upward and is adapted to be turned at a predetermined rate by means of a buff drive unit 31; the cylindrical buff 30 is also adapted to shift vertically and furthermore it is capable of being pressed laterally on the turning edge of the wafer W held by the wafer suction cup 25B with a predetermined pressure, as shown in FIG. 5.

The second chamfer polish station C is adapted to polish the chamfers along the orientation flat (OF chamfers) of the wafer W and it comprises a cylindrical buff 32, shown in FIG. 4.

In FIG. 4, the reference numeral 50 designates a conveyor belt which is wound round a pair of rollers 54, 55. A gear wheel 53 is provided at one end of the roller 54, and is meshed with a gear 52 locked about the end of the output shaft of a step motor 51. The other roller 55 is idle roller to rotate idly. Wafer cassettes loaded with unpolished wafers are one by one placed on the left end portion of the conveyor belt 50 by means of a robot arm, not shown, and ate conveyed toward the right end of the conveyor stepwise, by virtue of the step motor 51. First, the cassettes are each emptied at the wafer supply station A, and are step by step moved rightward and they are again loaded with wafers at the wafer discharge station E and then brought to the right end portion of the conveyor belt 50, where each cassette is picked off the conveyor belt 50 by a robot arm, not shown.

Next, the operation of the wafer chamfer polishing apparatus with a rotary circular dividing table of the present embodiment will be described with reference to the attached drawings.

When the turn disk (circular dividing table) 21 is turned to assume an angular position as shown in FIG. 4, the wafer suction cups 25A, 25B, 25C, 25D, 25E and 25F respectively coincide with the wafer supply station A, the first chamfer polish station B, the second chamfer polish station C, the wafer clean station D, the wafer discharge station E and the wafer suction cup clean station F. Then, at the wafer supply station A a first wafer W at the top of the wafer stack stored in the wafer cassette 40 is vacuum-held by the wafer suction cup 25A.

Meanwhile, at the first chamfer polish station B, a second wafer W (which was picked up at the wafer supply station A preceding the first wafer W) is being held by the suction cup 25B, and as the wafer drive motor 26 is operated and its rotational power is transmitted to the wafer suction cup 25B via the belt 27, the second wafer W is caused to rotate at a predetermined rate so that the chamfers of the entire non-OF edge of the wafer are polished by the inner wall of the cylindrical buff 28, which is also being turned round (ref. FIG. 4). As the second wafer W is rotated thus, the chamfers of the non-OF edge are entirely polished by means of the cylindrical buff 30.

At the same time, at the second chamfer polish station C also, a third wafer W (which was picked up at the wafer supply station A and had its non-OF chamfers polished at the first chamfer polish station B) is being held by the suction cup 25C, and as the wafer drive motor 26 is operated and its rotational power is transmitted to the wafer suction cup 25C via the belt 27, the third wafer W is caused to swing through a predetermined angle, so that the chamfers of the entire OF periphery of the wafer are polished by the cylindrical buff 32, which is also being turned round (ref. FIG. 4).

In the meantime, at the wafer clean station D, a fourth wafer W (which was picked up at the wafer supply station A and had its OF and non-OF chamfers polished at the first and second chamfer polish stations B and C) is being held by the suction cup 25D, and at this station D that portions of the wafer W which are not covered by the suction cup 25D are cleaned.

Meanwhile, at the wafer discharge station E, a fifth wafer W (which was picked up at the wafer supply station A and had its OF and non-OF chamfers polished at the first and second chamfer polish stations B and C, and which was cleaned at the wafer clean station D) is released by the wafer suction cup 25E, and then carried by a transportation means, not shown, into a cassette 41.

Finally at the wafer suction cup clean station F, the wafer suction cup 25F, which has released a sixth wafer W at the wafer wafer discharge station E and is therefore unloaded, has its suction cup lip cleaned.

Thus, as the respective operations at the wafer supply station A, the first chamfer polish station B, the second chamfer polish station C, the wafer clean station D, the wafer discharge station E, and the wafer suction cup clean station F are completed, a drive means, not shown, is operated to drive the turn disk 21 to turn clockwise through an angle of 60 degrees so that the wafer suction cups are indexed to the respective next stations: that is, the first wafer W picked up by the wafer suction cup 25A at the wafer supply station A is moved to stay at the first chamfer polish station B; similarly the second wafer W polished at the first chamfer polish station B is moved to stay at the second chamfer polish station C; the third wafer W polished at the second chamfer polish station C is moved to stop at the wafer clean station D, and the fourth wafer W cleaned at the wafer clean station D is moved to be discharged at the wafer discharge station E. Each of these four wafers receives the respective treatment as described above at the respective station newly arrived at.

The wafer suction cup 25F, which has discarded the fifth wafer W at the wafer discharge station E, is moved to the wafer supply station A to pick up another wafer W from the wafer cassette 40.

As this set of simultaneous operations are repeated six times, the turn disk 21 completes one turn and meanwhile the wafer which is picked up at the wafer supply station A at the beginning of the turn is polished at the first chamfer polish station B and at the second chamfer polish station C and is inserted in the wafer cassette 41. Thus, each time the turn disk 21 turns one sixth of a revolution, one polished wafer is added to the wafers in the cassette 41.

According to this embodiment also, each wafer W is kept held by a same wafer suction cup throughout the entire procedure and there occurs no transference of the wafer between suction cups; therefore, the same result is obtained as in the first embodiment.

Figure 6:
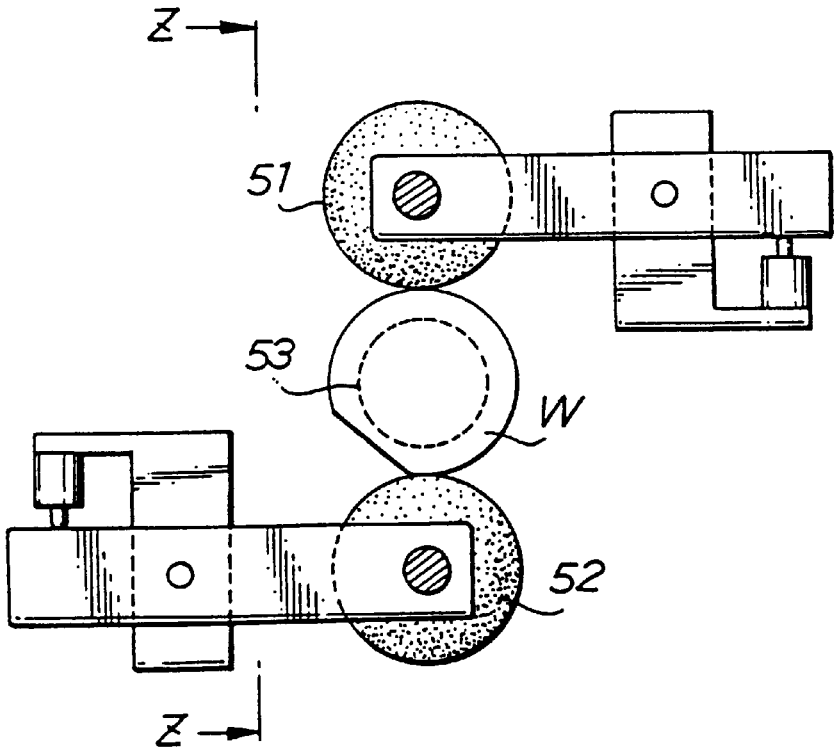
FIG. 6 is a top plan view of the first chamfer polish station of a wafer chamfer polish apparatus of a third embodiment of the invention wherein two solid cylindrical buffs are employed.
Figure 7:
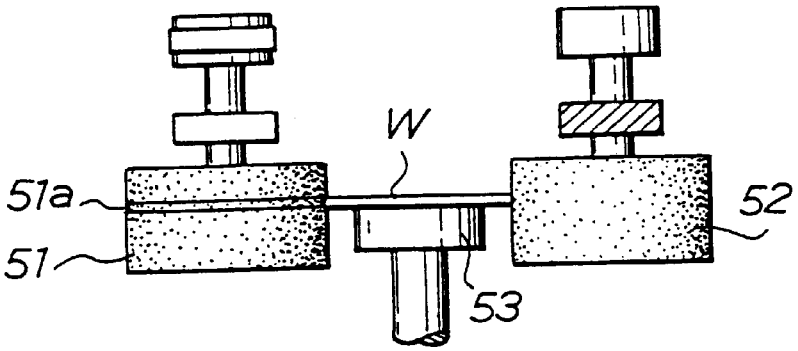
FIG. 7 is a vertical cross section taken on line Z—Z of FIG. 6.
Figure 8:
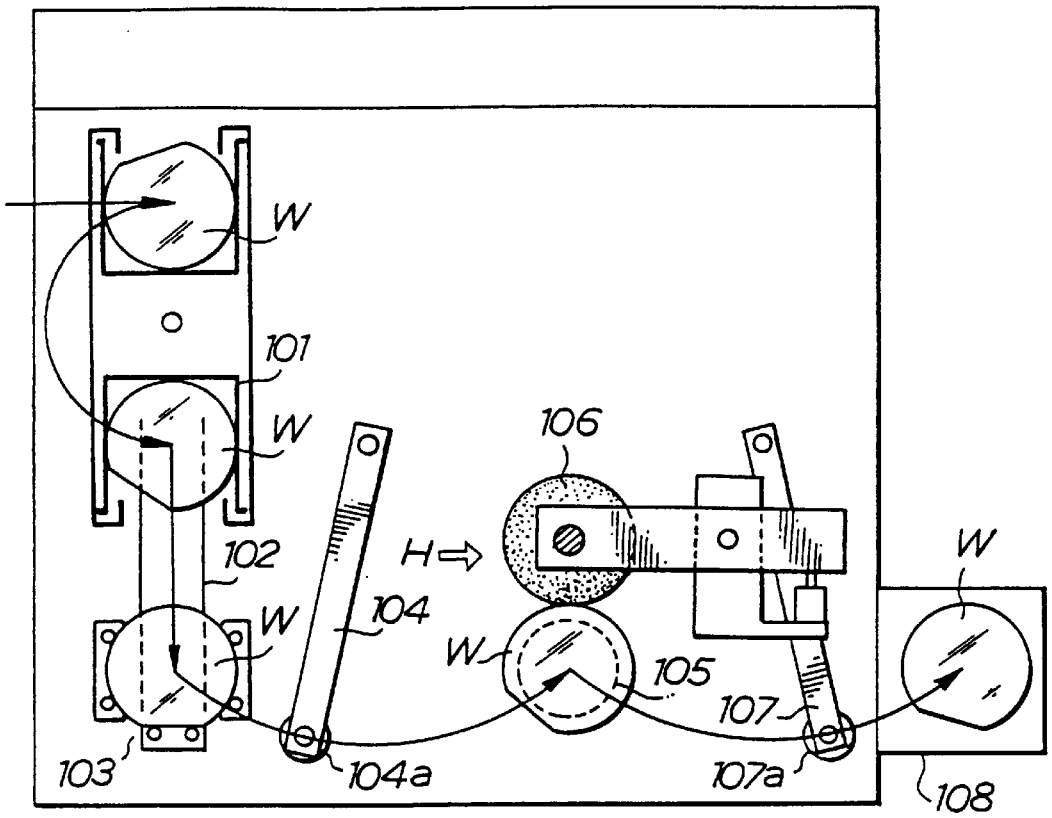
Fig. 8 PRIOR ART
FIG. 8 is a top plan view of a conventional wafer chamfer polishing apparatus.
Figure 9:
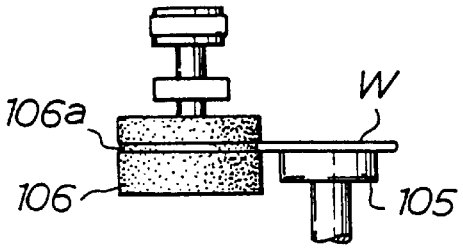
Fig. 9 PRIOR ART
FIG. 9 is a view seen in the direction of arrow H of FIG. 8.

In this second embodiment, the non-OF chamfers of each wafer W are polished by a single hollow buff 30 at the first chamfer polish station; but it is possible to design another embodiment wherein two cylindrical buffs 51 and 52 having external buffing walls are provided at the first chamfer polish station B of the second embodiment, as shown in FIG. 6 and FIG. 7. Incidentally, FIG. 6 is a top plan view of the first chamfer polish station of a wafer chamfer polish apparatus of the third embodiment of the invention wherein two solid cylindrical buffs 51, 52 are employed; and FIG. 7 is a vertical cross section taken on line Z—Z of FIG. 6.

Figure 10:
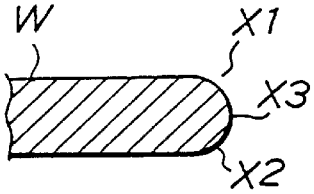
FIG. 10 is an enlarged cross section taken along a radius of a chamfered wafer.

As shown in FIG. 7, of the two buffs one 51 is provided with a groove 51*a* in the side wall to receive the non-OF peripheral edge of the wafer W in it. On the other hand, the buff 52 is without a groove. Both buffs 51, 52 are pressed on the periphery of the wafer W, which is held and turned by the rotary suction cup 53. Then, with reference to FIG. 10, both the tapered chamfers X1 and X2 are polished more selectively by the buff 51 and simultaneously as this the outermost chamfer X3 is more selectively polished by the buff 52; consequently, all of the chamfers of the non-OF periphery are polished at once; thus, by using two buffs for polishing of the non-OF peripheral edge, it is possible to further rationalize the chamfer polishing operation.

Thus, according to this two-buff system, since all the chamfers of the non-OF peripheral edge of the wafer W are polished simultaneously, the time required for the chamfer polishing is much reduced.

The second and said another embodiments are considered more advantageous than the first embodiment because in the first embodiment the wafer holder assemblies 15A, 15B, after releasing a wafer, must return to the wafer supply station a after travelling a long distance, whereas in the second or said another embodiment the wafer suction cups are for the most time holding a wafer and only briefly they are without a wafer. Thus, the time rate of production is higher in the cases of the second and said another embodiments.

Incidentally, in the second embodiment, when the cassette 40 becomes empty, the cassette 40 at the wafer supply station A is automatically moved rightward, as viewed in FIG. 4, and another cassette filled with wafers W is moved into the position where the cassette 40 was placed. Meanwhile, at the wafer discharge station E, the cassette 41 fully packed with polished wafers W is also automatically moved rightward and eventually removed from the wafer chamfer polish apparatus. After these moves, the empty cassette 40 will eventually come into the position which the cassette 41 is assuming as of FIG. 4, and there the cassette 40 is again filled with wafers W. Thus, according to this second embodiment, it is not necessary to manually remove the empty cassette from the wafer supply station A, nor is it necessary to manually place an empty cassette in the wafer discharge station E; as the result, the operation efficiency is improved.

Obviously many modifications and variations of the present invention are possible in the light of the above teachings. It is therefore to be understood that within the scope of the appended claims the invention may be practiced otherwise than is specifically described.

What is claimed is:

1. An apparatus for polishing chamfers of a semiconductor wafer having an orientation flat formed thereon, said apparatus including a hollow, cup-like cylindrical hollow polishing buff adapted to be rotated on a shaft and having a cylindrical wall at an outer periphery thereof including first and second substantially cylindrical polishing surfaces on outer and inner sides of said cylindrical wall, respectively, wherein said first and second polishing surfaces are adapted to polish different chamfers of said semiconductor wafer, said first polishing surface on said outer side of said cylindrical wall being shaped to polish chamfers of said orientation flat of said wafer, and said second polishing surface on said inner side of said cylindrical outer-wall being shaped to polish chamfers at a periphery of said wafer other than said orientation flat, and wherein one of said first and second polishing surfaces includes a groove.

* * * * *